US010196231B2

(12) United States Patent
Jensen et al.

(10) Patent No.: US 10,196,231 B2
(45) Date of Patent: Feb. 5, 2019

(54) METHOD AND DEVICE FOR RESTORING OF CORES

(75) Inventors: Jörgen Jensen, Falkenberg (SE); Jan Karlsson, Falkenberg (SE); Nils Strandh, Gullbrandstorp (SE)

(73) Assignee: CORE LINK AB, Falkenberg (SE)

( * ) Notice: Subject to any disclaimer, the term of this patent is extended or adjusted under 35 U.S.C. 154(b) by 1451 days.

(21) Appl. No.: 13/244,451

(22) Filed: Sep. 24, 2011

(65) Prior Publication Data

US 2012/0060865 A1 Mar. 15, 2012

(30) Foreign Application Priority Data

Sep. 10, 2010 (SE) ..... 1000999

(51) Int. Cl.
*B65H 3/00* (2006.01)
*B65H 73/00* (2006.01)

(52) U.S. Cl.
CPC ..... *B65H 73/00* (2013.01)

(58) Field of Classification Search
CPC ..... B65H 73/00
USPC ..... 225/1; 83/633, 674, 675, 733, 27, 160, 83/801, 571, 159, 102, 862, 100, 62, 36, 83/8, 435.2, 446, 508.2, 924, 54, 368, 83/425, 447, 449, 881, 947; 134/6; 15/236.01
See application file for complete search history.

(56) References Cited

U.S. PATENT DOCUMENTS

| | | | | |
|---|---|---|---|---|
| 1,555,391 | A * | 9/1925 | Surfus | 162/285 |
| 1,838,011 | A * | 12/1931 | St Peter | 83/862 |
| 2,098,123 | A * | 11/1937 | Wood | 30/287 |
| 2,537,237 | A * | 1/1951 | Rosser, Sr. | 30/90.4 |
| 3,245,302 | A * | 4/1966 | Bayley | 83/614 |
| 3,605,542 | A * | 9/1971 | Smith et al. | 83/564 |
| 4,507,867 | A * | 4/1985 | Haas, Jr. | 30/90.4 |
| 4,597,820 | A * | 7/1986 | Nozaka | 156/353 |
| 4,779,498 | A * | 10/1988 | Perkins | 83/18 |
| 5,094,003 | A * | 3/1992 | Schwab | 30/329 |
| 5,759,350 | A * | 6/1998 | Pyron et al. | 162/191 |
| 6,711,824 | B2 * | 3/2004 | Hruska | 30/294 |

FOREIGN PATENT DOCUMENTS

| | | |
|---|---|---|
| SE | 519 378 | 2/2003 |
| SE | 533 080 | 1/2006 |
| WO | WO 00/62981 | 10/2000 |
| WO | WO 2007/116120 A1 | 10/2007 |

* cited by examiner

*Primary Examiner* — Ghassem Alie
(74) *Attorney, Agent, or Firm* — McGinn I.P. Law Group, PLLC.

(57) ABSTRACT

A method (and device) of removing material residues, from cores to make possible reuse of them in the same manner as new and unused cores a number of times wherein cores with material residues in the form of a number of material turns are processed using a mechanism for lifting and tearing the material residues for subsequent simple removal thereof, the mechanism for lifting and tearing of the material residues is displaced along the core and the mechanism for lifting and tearing of the material residues is displaced from a position in on the core out towards and past the ends of the core.

14 Claims, 6 Drawing Sheets

METHOD AND DEVICE FOR RESTORING OF CORES

The present invention relates to a method according to the preamble to appended claim 1 and a device for carrying the same into effect.

In particular within the tissue industry, use is made of large cores of an inner diameter of, for example, 250 to 600 mm. For economic and not least environmental reasons, it is a major advantage if such cores can be recycled and reused as many times as possible. Hitherto, such cores have been cleaned from material residues manually using knives. This often leads to damage to the extremely sensitive casing material and such damage makes reuse of these cores impossible. There is thus a major need in the art for a method and a device for restoring used cores in as gentle a manner as possible without damage to the sensitive casing material of the core.

The task forming the basis of the present invention is to realise such a method and a device for carrying the method into effect.

This task is realised by means of the present invention in the method disclosed by way of introduction in that the method has been given the characterising features as set forth in appended claim 1 and the device for carrying the method into effect has been given the characterising features as set forth in appended claim 4.

The present invention realises an as good as automatic cleaning or restoring of used cores for use within the tissue industry to the same condition as new and unused cores as good as without risk of damage to the sensitive casing material. This implies major savings from both the economic and the environmental viewpoints.

The present invention will now be described in greater detail hereinbelow with reference to the accompanying Drawings.

The method according to the present invention will be clearly apparent in the following description of different embodiments of a device according to the present invention for carrying the method into effect.

A core with material residues in the form of a relatively large number of turns of paper tissue is processed in a core cleaner or roll cutter with a circular knife of per se known type for removing the greater part of the tissue. The innermost layers or turns of the tissue are left on the core so that the sensitive casing surface of the core is not subjected to any damage by the parts in the core cleaner or roller cutter. Those parts which may entail damage to the casing surface of the core are moved aside or the core is moved away from them in order to make possible continued processing of the material residues on the core according to the present invention.

Figure 1:
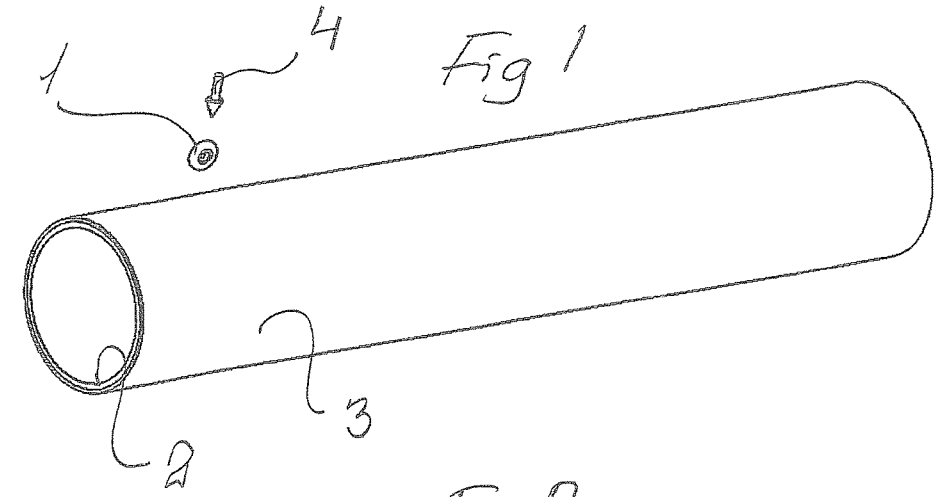
FIG. 1 is a perspective view of a core at a part of a device according to one embodiment of the present invention.
Figure 2:
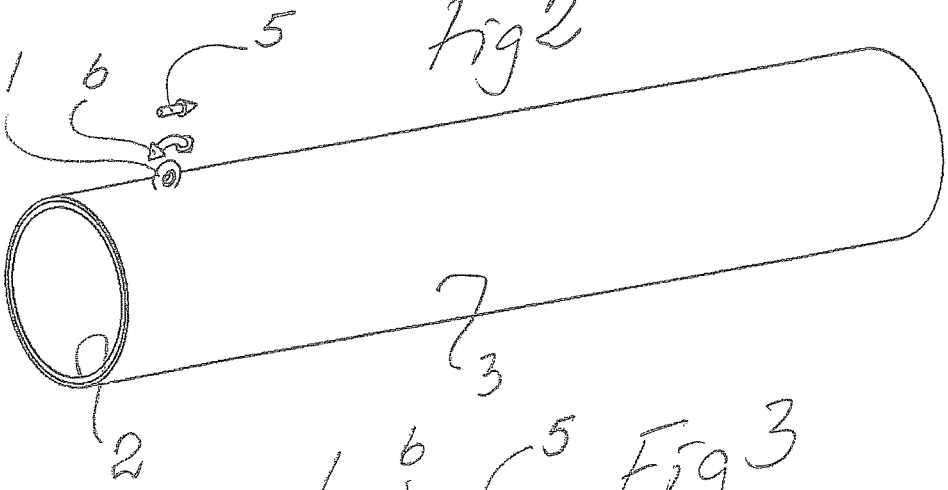
FIG. 2 is a view similar to that of FIG. 1 but with the part in a different position.
Figure 3:
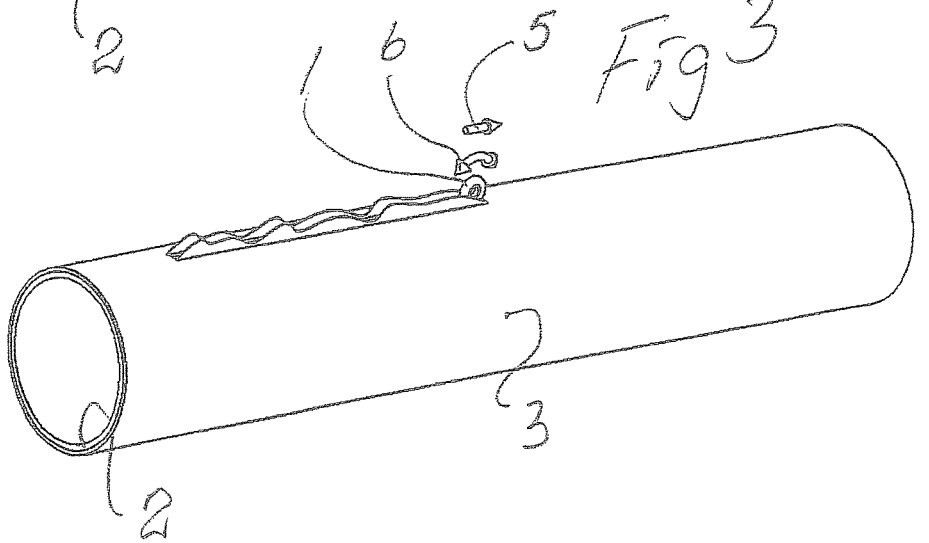
FIG. 3 is a view similar to those of FIGS. 1 and 2 with the part in yet another position.
Figure 4:
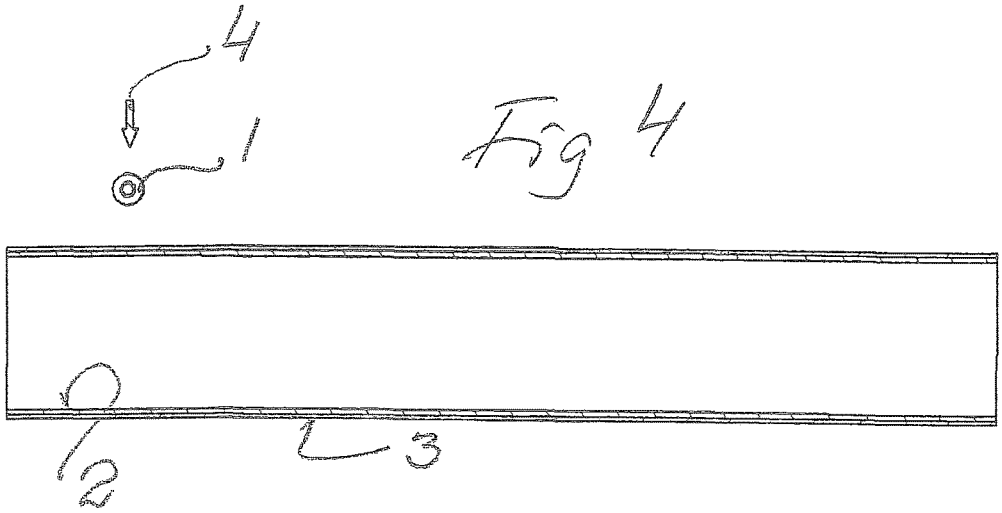
FIG. 4 is a longitudinal section through the parts in FIG. 1.
Figure 5:
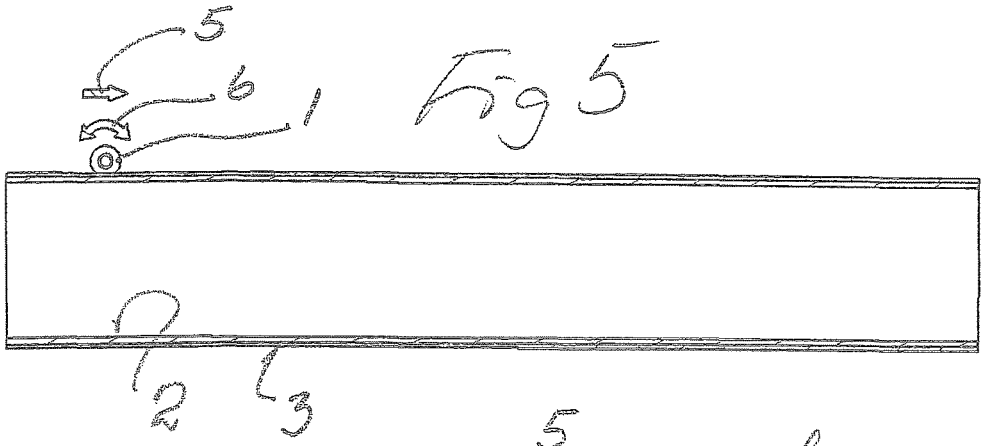
FIG. 5 is a longitudinal section through the parts in FIG. 2.
Figure 6:
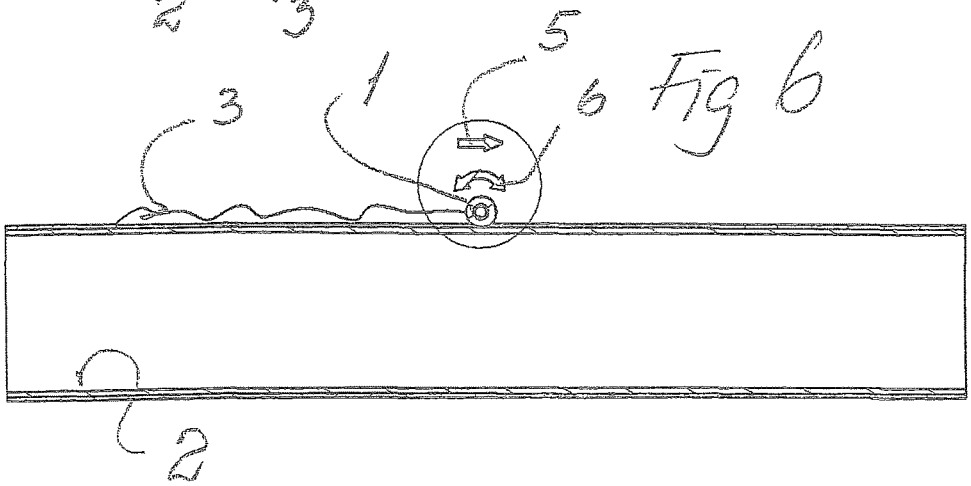
FIG. 6 is a longitudinal section through the parts in FIG. 3.
Figure 7:
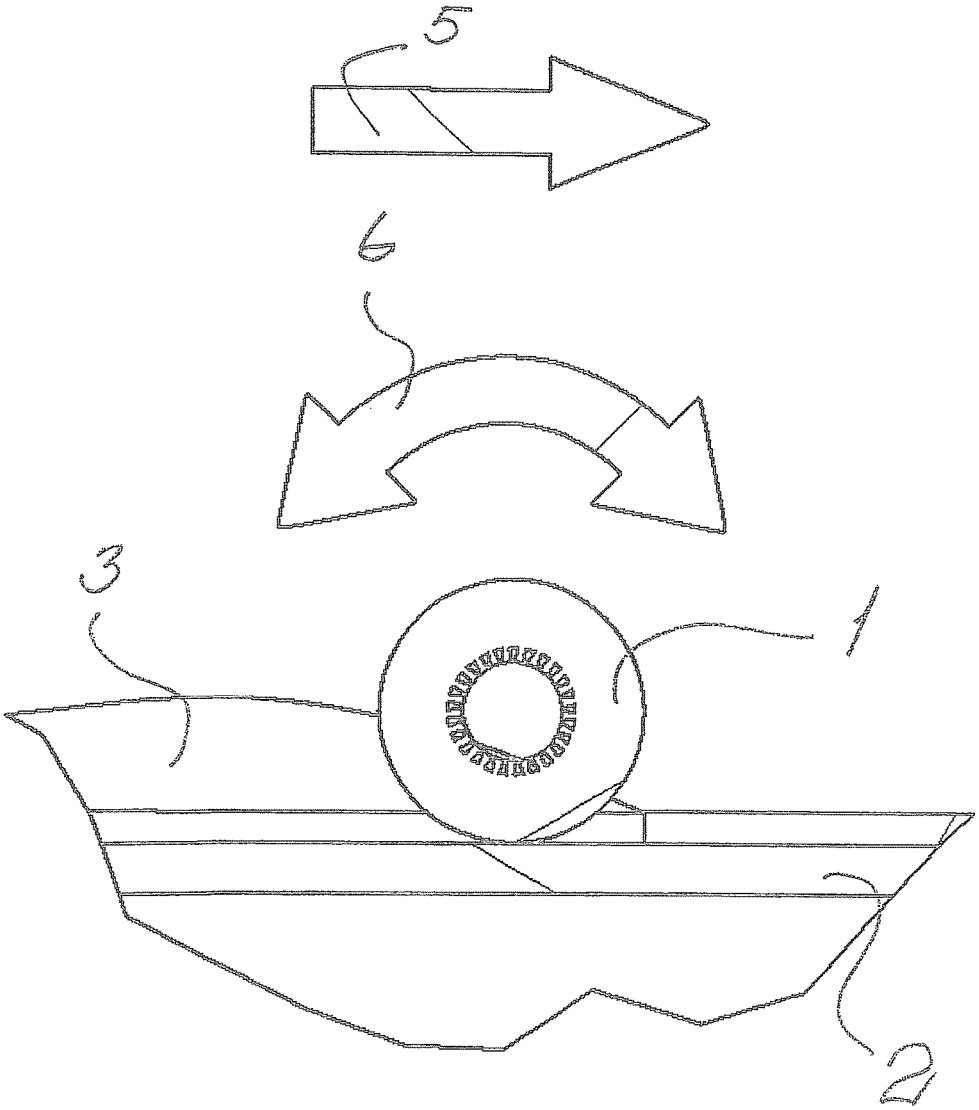
FIG. 7 shows, on a larger scale, a part of the longitudinal section in FIG. 6, the part being encircled.

In FIGS. 1-7 there is illustrated a device according to one embodiment of the present invention, consisting of a wheel 1 which is urged against a core 2 with tissue 3 in the direction of the arrow 4. The wheel 1 has a friction surface and is advantageously manufactured from rubber or a rubber-like material, e.g. polyurethane. The wheel 1 may have a rounded narrow circumferential surface. The wheel 1 is displaced in the direction of the arrow 5 in FIG. 2 along the core 2 and is rotated in accordance with the arrow 6 in a direction towards the direction of displacement in accordance with the arrow 5 to the end of the core 2. Before the wheel 1 is displaced in the opposite direction to the opposite end of the core 2, its direction of rotation is reversed so that the wheel 1 rotates towards the axial direction of movement. This alternating displacement of the wheel 1 is continued until the tissue is split up as intimated in FIGS. 3, 6 and 7 and until the casing surface of the core 2 is visible. It is important that the wheel 1 is mounted resiliently so that the casing surface of the core 2 is not damaged.

It is also possible to rotate the wheel 1 with the axial direction of displacement on condition that its peripheral speed is different from (preferably greater than) the axial speed of displacement. One advantage with this is that it is possible to avoid the occurrence of a so-called "rolled edge" of the tissue, which is extremely difficult to split but must be cut, with considerable risk of damage to the casing surface of the core 2.

After the lifting and splitting or tearing of the tissue according to the preceding paragraph, either the core 2 may be rotated, a doctor blade be applied in the opening and the core rotated, or air be blown down into the opening thus created for removal of the tissue. These removal methods may naturally also be combined with one another for removal of residual tissue from the core 2.

Figure 8:
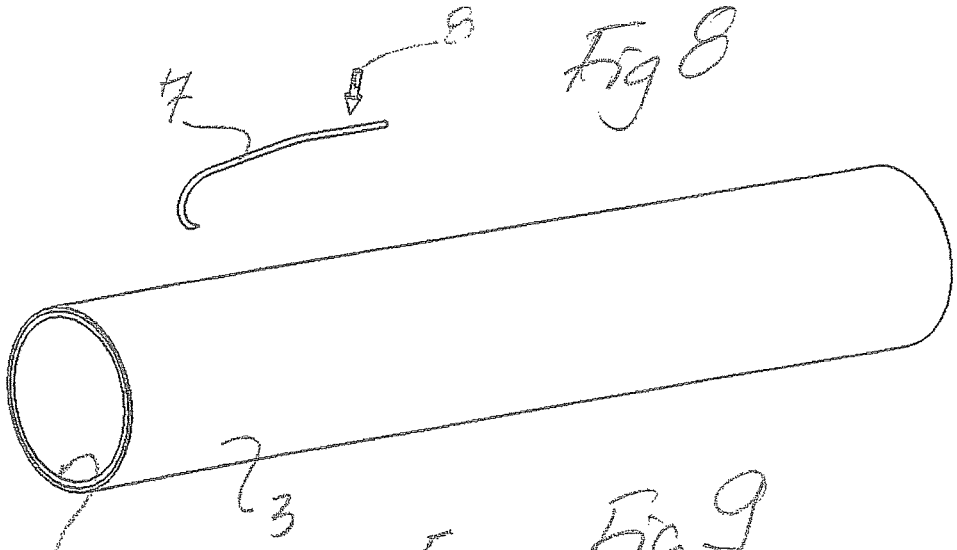
FIG. 8 is a perspective view of a core at a part of a device according to another embodiment of the present invention.
Figure 9:
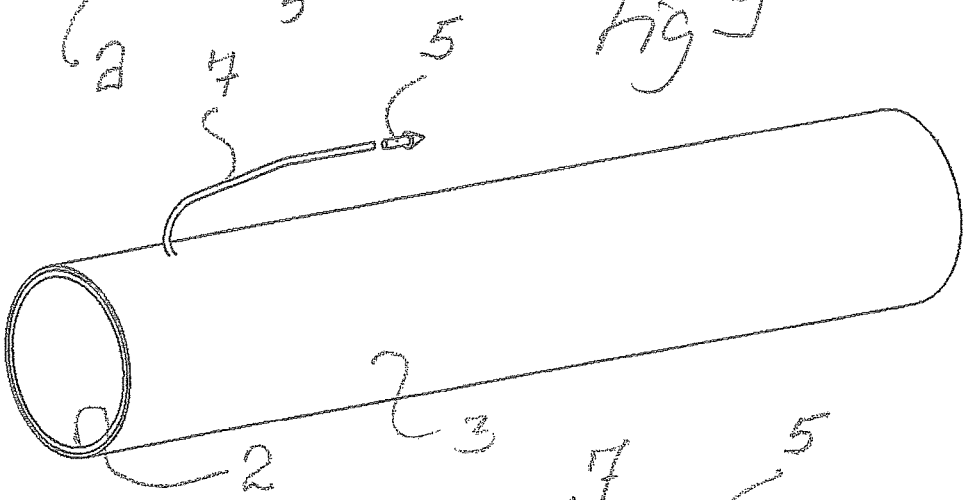
FIG. 9 is a view similar to that of FIG. 8 with the part in a different position.
Figure 10:
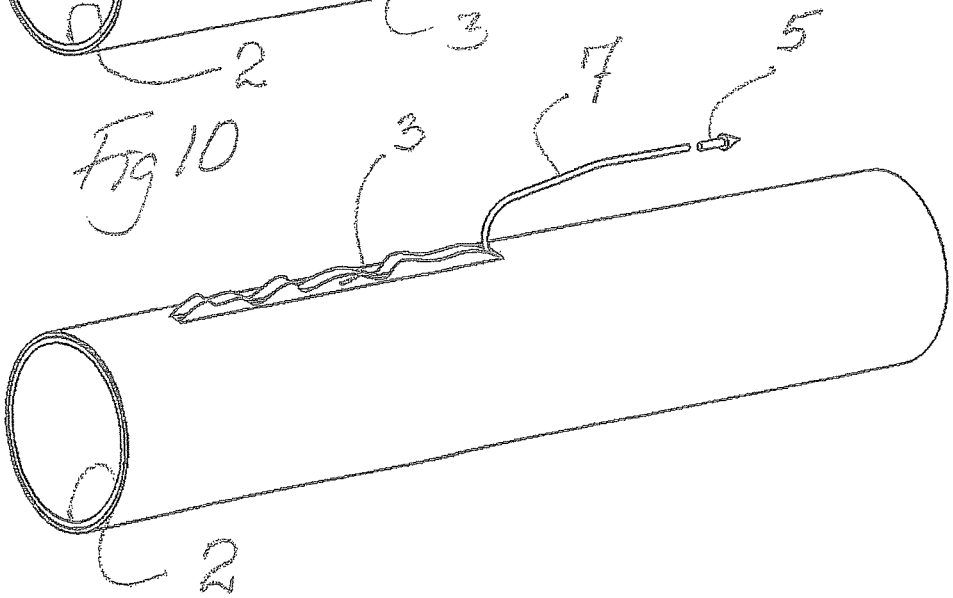
FIG. 10 is a view similar to those of FIGS. 8 and 9 with the part in yet another position.
Figure 11:
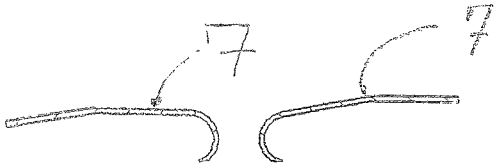
FIG. 11 is a longitudinal section through the parts in FIG. 8.
Figure 12:
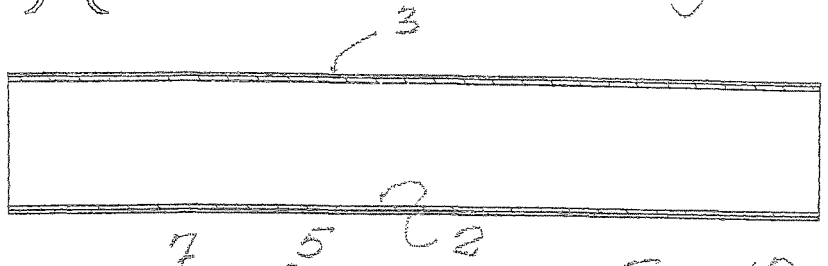
FIG. 12 is a longitudinal section through the parts in FIG. 9.
Figure 12:
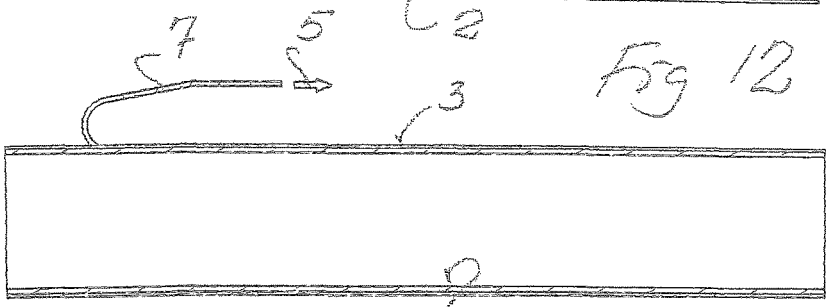
Figure 13:
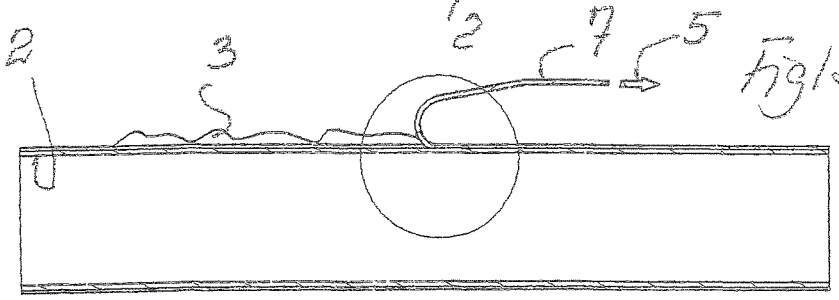
FIG. 13 is a longitudinal section through the parts in FIG. 10.
Figure 15:
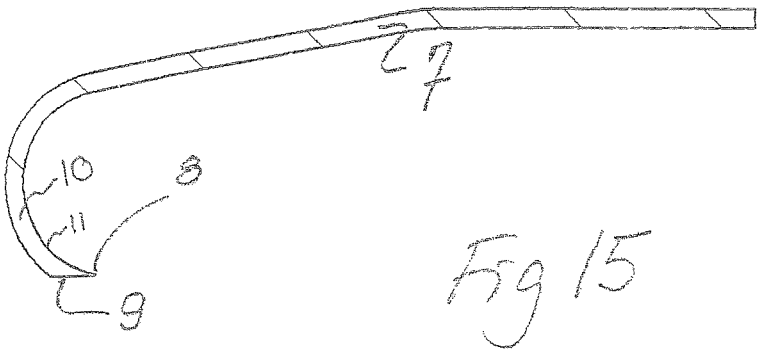
FIG. 15 is a view of a part of a device according to one embodiment of the present invention.
Figure 14:
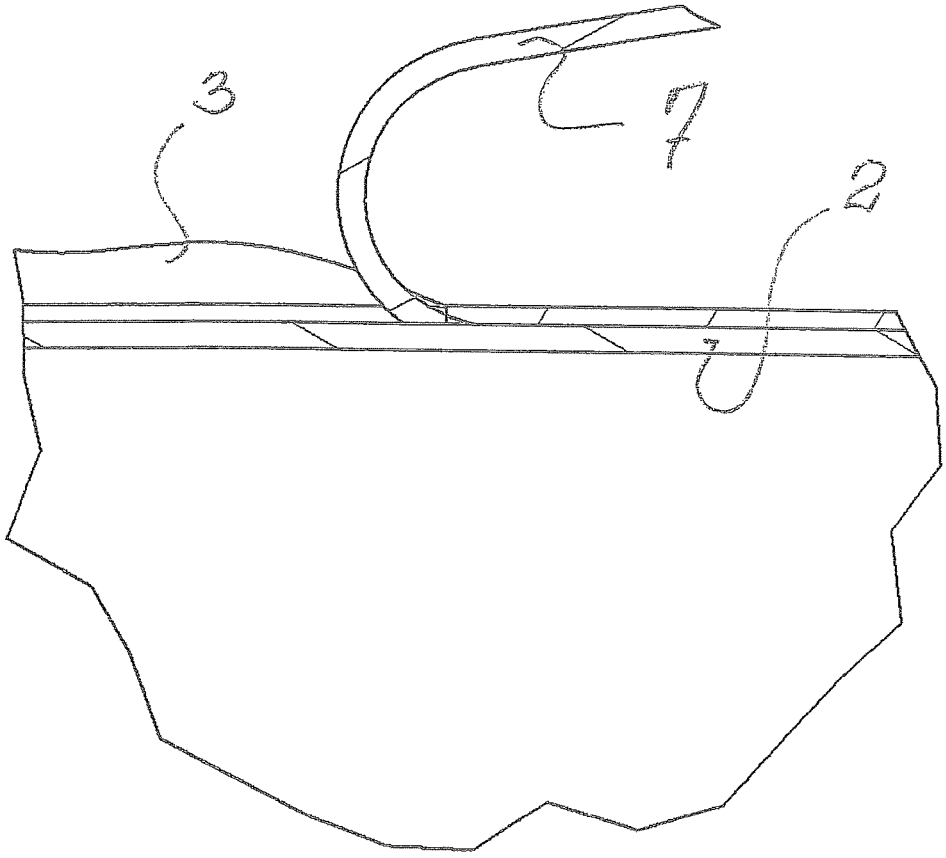
FIG. 14 shows, on a larger scale, a part of the longitudinal section in FIG. 13, the part being encircled.

FIGS. 8-15 illustrate another embodiment of a device according to the present invention in which the wheel 1 has been replaced by a hook 7 which, in a position slightly inside the end of the core 2, is urged in the direction of the arrow 8 towards the material residues or the tissue 3 on the core 2 and is displaced axially along the core 2 in the direction of the arrow 5 to the opposite end of the core 2. The hook has a tip carrier 10 which includes an abutment surface 9, a sloped surface 11, and a tip 8. In this displacement, the hook 7 or its tip 8 will strive down towards the casing surface of the core 2 and parallel therewith while tearing up the tissue 3, until the end of the core 2 has been passed. Either the hook 7 may be reversed or another similar hook may be provided for displacement in the opposite direction after engagement in the tissue a distance inside the opposite end of the core 2. The hook 7 or the hooks are displaced reciprocally on the core 2 until the surface 9 of the tip 8 comes into abutment against the casing surface on the core 2 and is displaced thereon without causing any damage. To this end, the surface 9 may be directed slightly upwards towards the tip 8 proper. Changes in the direction of the surface 9 towards and away from a parallel state with the casing surface of the core may be realised by pivoting the hook 7 and its tip 8 upwards or downwards.

After the raising and splitting or tearing of the tissue according to the preceding paragraph, either the core 2 may be rotated, a doctor blade applied in the opening and the core rotated or air blown down into the opening created for removal of the tissue. These removal methods may naturally also be combined with one another for removal of the residual tissue from the core 2.

In combination with a core cleaner or a roll cutter with circular fixed or rotating knife, a wheel 1 or a hook 7 may be disposed on one or both sides of the knife in the core cleaner or roll cutter and be lifted or lowered with the knife and may also be moveable independently of the knife. Suitably, the hook 7 may be pivotally mounted about its opposite end in relation to the tip 8 and may be connected to a cylinder or the like for pivoting against the casing surface of the core 2 with the desired force. Trials have demonstrated that it is sufficient to use the natural weight of the hook 7 in order for the hook to penetrate into and down in the tissue 3.

Many modifications of the above described embodiments according to the present invention are naturally conceivable without departing from the scope of the inventive concept as defined in the appended Claims.

The invention claimed is:

1. A method of removing material residues from a core, the core including layers of the material residues disposed on a casing surface of the core, the method comprising:

lifting and tearing the material residues from the core;

processing the core with the material residues, using a means for lifting and tearing devoid of a knife, to remove the material residues from the core as close to the surface of the core as possible without damaging the surface of the core; and during said processing of the core, displacing said means for lifting and tearing in an axial direction from a first position on the core to a second position located past a distal end of the core, wherein said means for lifting and tearing allows a plurality of reuses of the core in a same manner as a new and unused core.

2. The method as claimed in claim 1, wherein said means for lifting and tearing of the material residues is urged in a direction towards the casing surface of the core for penetration into the material residues under lifting and tearing of the material residues on the core during the displacing of said means for lifting and tearing.

3. The method as claimed in claim 2, wherein the means for lifting and tearing comprises a plurality of means for lifting and tearing, the plurality of means for lifting and tearing of the material residues on the core being displaced each from a position on the core towards and past the distal end of the core.

4. The method as claimed in claim 1, wherein the means for lifting and tearing comprises a plurality of means for lifting and tearing of the material residues on the core, the plurality of means for lifting and tearing being displaced each from a position on the core towards and past the distal end of the core.

5. A device for performing the method according to claim 1, the device comprising:

a wheel or a hook comprising said means for lifting and tearing of the material residues, wherein said means for lifting and tearing of the material residues is displaced from the first position to the second position while urging said means for lifting and tearing against the material residues disposed on the core.

6. The device as claimed in claim 5, wherein the wheel is provided with a friction surface and is connected to means for rotation thereof against their axial direction of displacement over the core.

7. The device as claimed in claim 6, wherein the wheel is connected to means for rotation thereof with its axial direction of displacement at a peripheral speed which is different from, preferably higher than, the speed of the axial displacement.

8. The device as claimed in claim 5, wherein the wheel is connected to means for rotation thereof with its axial direction of displacement at a peripheral speed which is different from, the speed of the axial displacement.

9. The device as claimed in claim 5, wherein the wheel is yieldably applied against the core and the material residues thereon.

10. The device as claimed in claim 5, wherein the hook has a tip carrier including:

an abutment surface configured to face towards the core; and a tip located at an end of the abutment surface and pointed in a direction of displacement, wherein the abutment surface is slightly inclined in an upward direction away from the core and towards the direction of displacement of the hook so that the tip is located slightly above the casing surface of the core when the abutment surface abuts the casing surface of the core.

11. The device as claimed in claim 10, wherein the tip carrier further includes a sloped surface facing away from the core which slopes from the tip upwards and away from the core, and wherein the sloped surface is configured for lifting of the material residues up from the core.

12. The device as claimed in claim 10, wherein the hook comprises a plurality of tip carriers such that a first tip of a first tip carrier faces opposite to a second tip of a second tip carrier.

13. The method as claimed in claim 1, further comprising:

during said processing of the core, displacing said means for lifting and tearing from the second position located past the distal end of the core to a third position which is located past the opposite distal end of the core.

14. The device as claimed in claim 1, wherein the core comprises an inner diameter of 250 mm to 600 mm.

* * * * *